United States Patent [19]

Giulie

[11] 4,436,968

[45] Mar. 13, 1984

[54] MULTIPLE POSITION SWITCH

[76] Inventor: Joe D. Giulie, P.O. Box 51350, Palo Alto, Calif. 94303

[21] Appl. No.: 329,342

[22] Filed: Dec. 10, 1981

[51] Int. Cl.[3] ..... H01H 9/00; H01H 15/00; H01H 19/00

[52] U.S. Cl. ..... 200/5 R; 200/11 R; 200/16 E

[58] Field of Search ..... 200/1 R, 5 R, 6 R, 11 R, 200/11 TC, 16 R, 16 A, 16 B, 16 E, 16 F, 17 R, 51 R, 11 A, 17, , 51.04, 51.12; 361/427–429, 432, 350, 351

[56] References Cited

U.S. PATENT DOCUMENTS

| | | | |
|---|---|---|---|
| 2,000,231 | 5/1935 | Hepler | 200/16 E |
| 3,187,120 | 6/1965 | Akst | 200/16 E |
| 3,280,275 | 10/1966 | Sheffield | 200/16 E |
| 3,377,444 | 4/1968 | Doubt | 200/16 E |
| 3,670,117 | 6/1972 | Yancey | 200/16 C |
| 3,796,845 | 3/1974 | Shirae | 200/16 A X |

FOREIGN PATENT DOCUMENTS

| | | | |
|---|---|---|---|
| 567449 | 12/1923 | France | 200/16 E |

*Primary Examiner*—J. R. Scott
*Attorney, Agent, or Firm*—Robert G. Slick

[57] ABSTRACT

A multiple position switch is provided which is actuated by a lever to plug the switching element into a selected one of a plurality of receptacles. The switch is particularly applicable in connection with peripheral equipment for computers.

21 Claims, 10 Drawing Figures

MULTIPLE POSITION SWITCH

SUMMARY OF THE INVENTION

The present invention relates to a switch which enables one by the simple actuation of a lever to plug one or a plurality of conductors into a selected one of several receptacles. In accordance with one embodiment of the invention, a plurality of inputs can be provided as well as a plurality of outputs.

The present invention relates primarily to a switch which is applicable in computer installations although it will be recognized that the switch is one of wide utility and can be used in other environments. In computer applications, it is frequently necessary to interface two units with conductors. Frequently as many as 25 conductors will need to be switched from one circuit to another. Various examples could be cited such as the interface between a computer and two different printers. Another would be the use of a single CPU to various CRT monitors. One might interface a single word processor to either a draft quality printer or a letter quality printer. Another example would be from a computer to a modem or CRT or printer.

In accordance with one embodiment of the invention, one may provide a plurality of input ports as well as a plurality of output ports. Thus, one might wish to connect selectively 2 CPU's to 5 output ports or perhaps 2 computers to several modems. These are merely typical examples of the myriad applications of the present invention.

In the past various methods have been used to interface various computer related items. The oldest is perhaps an actual cable change wherein one unit is unplugged and another unit is plugged in. This of course requires some knowledge and manual dexterity and it is ordinarily necessary to power down the various units while the switching is going on. Another method is to employ rotary wafer switches with printed circuit boards between the various wafers of the switches. This is frequently unsatisfactory in actual use since such switches are very expensive, the wafers frequently get out of alignment (some switches employ as many as 24 wafers) and the printed circuit boards which may be used as interconnection devices are frequently unreliable. Further, such switches have a high capacity between the various conductors so that they are subject to cross talk. The switches themselves have a relatively high resistance and can introduce an impedance change in lines operated at high frequency.

The switch of the present invention obviates the above disadvantages. The switch can employ standard connectors which have proved reliable over the years so that it is not necessary to rely on connections between unproved devices. The device of the present invention is relatively simple so that it can be made at a very low cost and, since it is simple, it is extremely reliable and trouble free.

Since the switch of the present invention can employ (although it is not necessary) standard connectors, it is not necessary to rely upon relatively new and unproved switching contacts. The connectors of the present invention have a very low resistance, are capable of passing a high current and have low interelectrode capacity so that there is little chance for cross talk or shorts.

The device of the present invention is also more compact than units heretofore known. It is not necessary to have any particular knowledge or manual dexterity to operate the switch.

Other features and advantages of the invention will be brought out in the balance of the specification.

DESCRIPTION OF THE PREFERRED EMBODIMENTS

Figure 1:
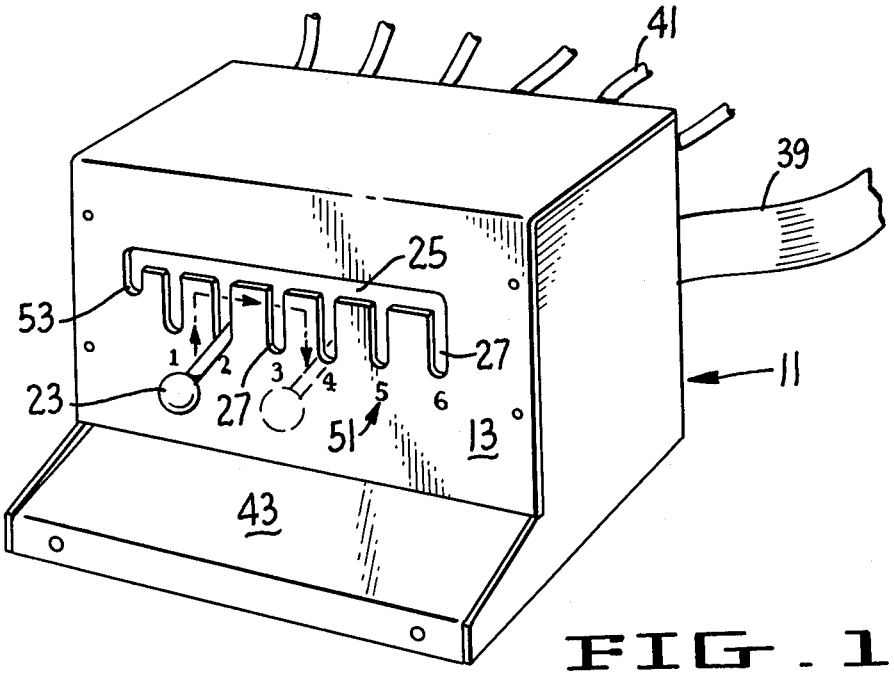
FIG. 1 is a perspective view of a switch embodying the present invention.
Figure 2:
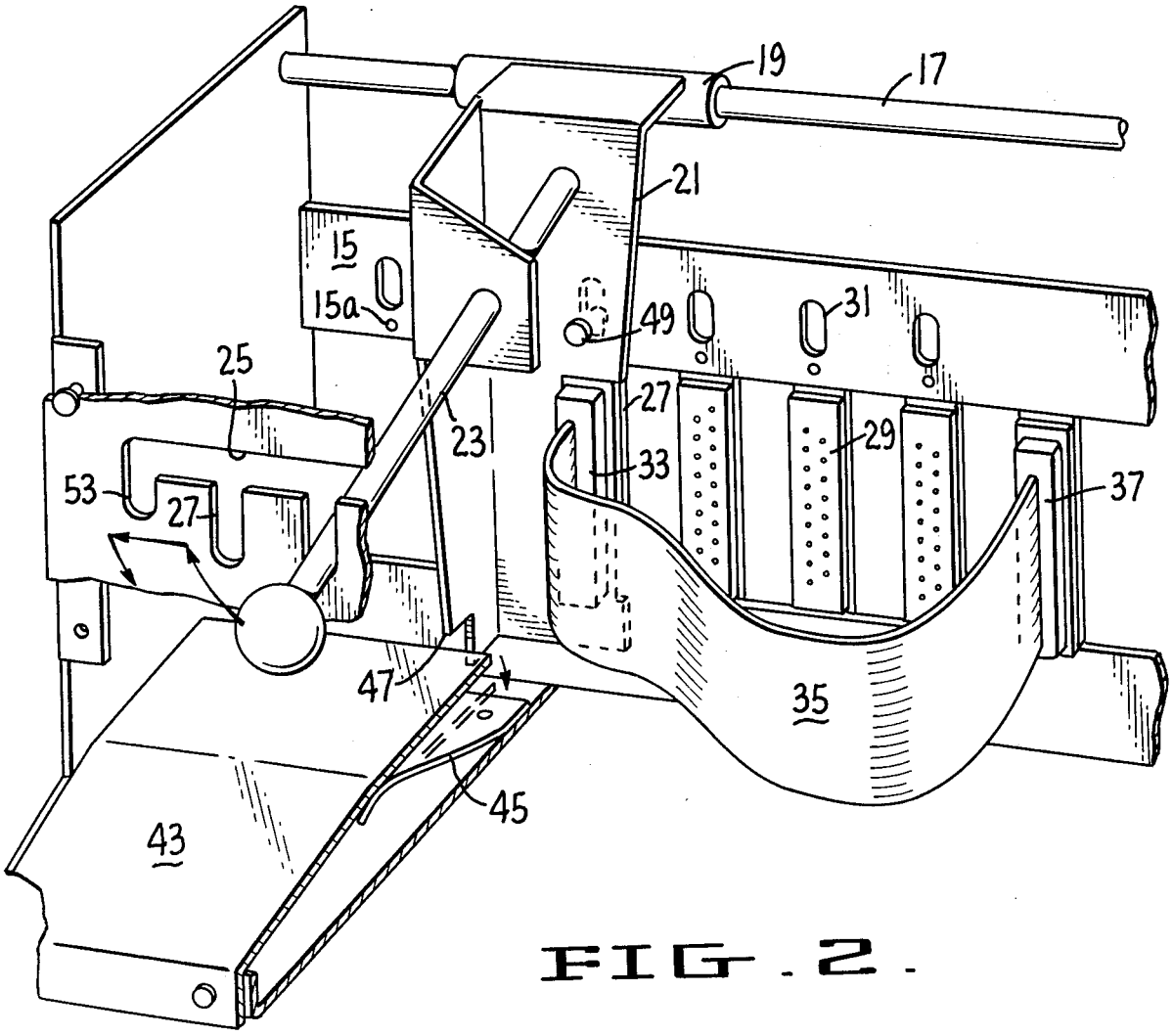
FIG. 2 is an enlarged partial view, partly in section, of the interior workings of the switch shown in FIG. 1.
Figure 3:
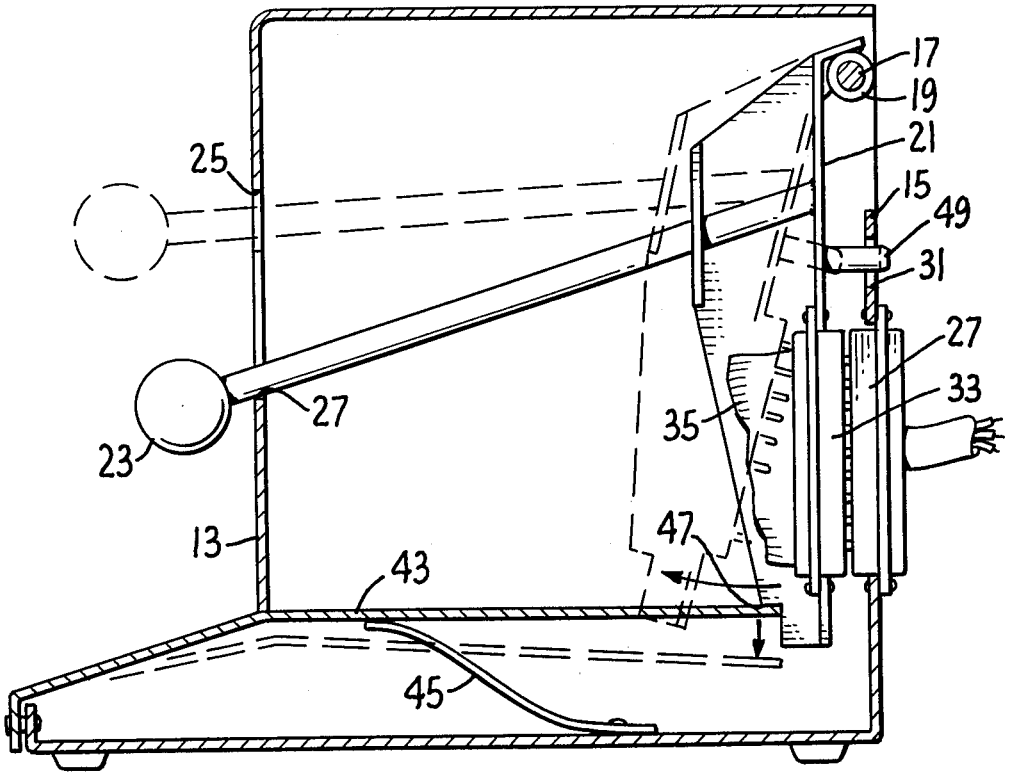
FIG. 3 is a side view of the switch, partly in section.
Figure 4:
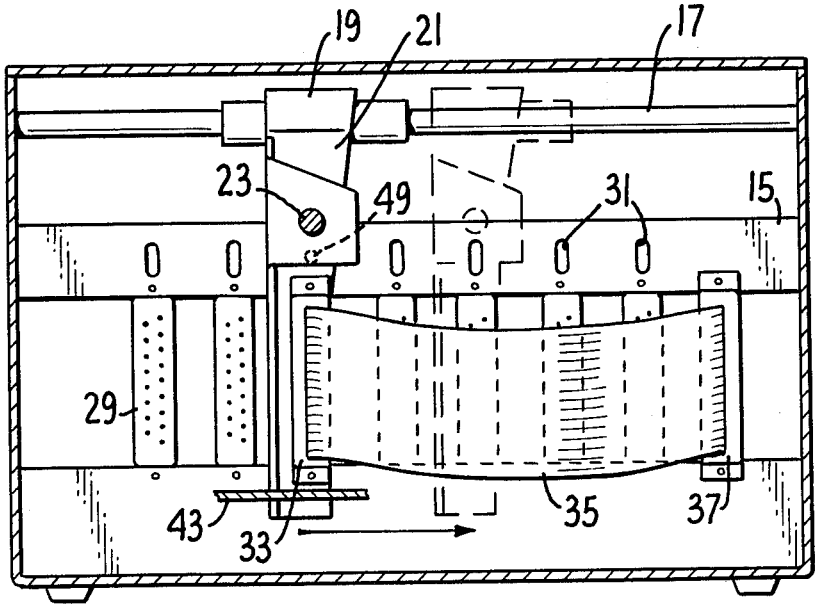
FIG. 4 is a plan view of the switch, partly in section.

Referring now to the drawings by reference characters and particularly FIGS. 1 through 4, a preferred embodiment of the switch is shown wherein a single connector can be selectively connected to 6 second connectors. In this embodiment of the invention, the fixed or second connectors are shown to be female connectors while the movable connector is shown to be a male connector since this is the preferred configuration of the connectors. However, the invention would be equally workable with a reversal of the connectors. The connectors can be standard multiple contact connectors such as those which are commonly used on computers. This is preferred since such connectors have a known performance record and are readily acceptable by purchasers. However, it is possible to employ special connectors constructed particularly for use in the switch of the present invention.

The switch of the present invention can be mounted in a cabinet 11 having a front wall 13 and a rear wall 15. Suspended in the framework of the cabinet is a rod 17 extending from side to side while a slider 19 is adapted to slide along the rod 17 as well as to pivot around the rod. Slider 19 carries an arm 21 as well as a handle 23. As is best seen in FIG. 1, the handle 23 extends out through a horizontal slot 25 in the front wall 13. This slot extends from side to side of the cabinet while a plurality of vertical slots 27 extend downwardly from the slot 25.

The back wall 15 is provided with mounting holes **15*a* so that the user's cables terminating in female connectors, such as those designated 27 and 29, can be mounted, there being one such connector for each of the slots 27 on the front of the cabinet. Above each of the female connectors is a slot such as the one designated 31** which serves as a locating slot as is later explained.

The arm 21 carries a male connector 33 which is connected by means of a multiple wire ribbon cable 35 to an input connector 37. The input connector is connected to an incoming cable 39 by any suitable means while the female connectors such as 27 and 29 are connected to suitable output cables such as that shown at 41. It will be understood, of course, that the terms "input" and "output" are selected only for ease of description and that the connections could easily be reversed.

A pivoted plate 43 extends to the front of the switch and this is normally biased upwardly by a spring 45 with locks into a notch 47 on arm 21, so that if the plate is in the upper position, arm 21 is locked in place, but if it is pressed downwardly, the arm is released.

A pin 49 extends to the rear from arm 21 and serves as a locating pin by engaging in a slot 31. On the front plate 13 indicia 51 may be provided to indicate the slot in which the handle 23 is placed. Also, a short slot 53 may be provided which serves as an off or neutral position.

It is believed that the switching action is now apparent. The input connector 39 could be connected to some computer device while the multiple output connectors 41 would each be connected to one of the female connectors such as 27 or 29. In order to move the connection from one device to another, one presses down on the plate 43 so that it is depressed to the position shown in dashed lines in FIGS. 2 and 3 which releases the arm 21. Now one may raise the handle 23 and slide it along to the desired new position along the slot 25. The slots 27 in the front of the switch give the approximate location of the connector while the action of the pin 49 in one of the slots 31 gives a very precise positioning of the connector. One now presses down on arm 23, completing the new connection.

Figure 5:
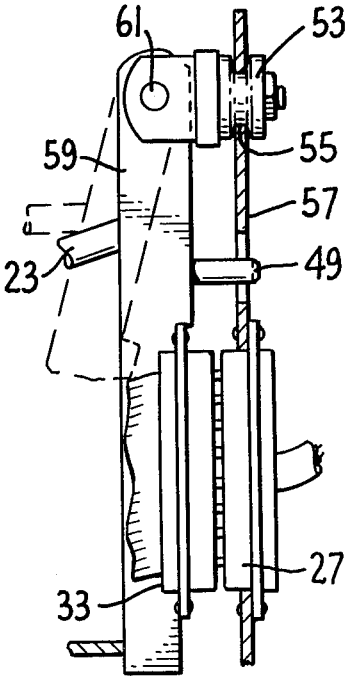
FIG. 5 is a partial side view showing an alternate slide mechanism.

Other means can be used to permit the arm 21 to traverse across the various output connectors. In FIG. 5 there is shown a slider 53 which moves in a slot 55 which extends across the back wall 57 of a switch. A lever arm 59 mounted on a pivot 61 is attached to the slider. Thus, the arm 59 can move from side to side moving through the slot 55 or can swing outwardly to the position in dashed lines around the pivot 61.

Figure 6:
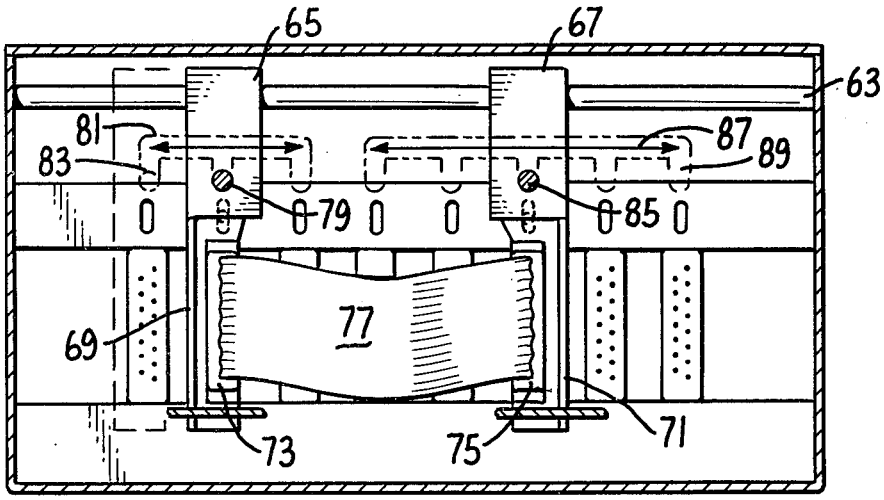
FIG. 6 is a front view, partly in section, of another embodiment of the invention employing 2 sliders with 3 ports which can be connected at will to 5 ports.

As was earlier mentioned, multiple movable connectors may be employed in a situation where one has a plurality of input ports and a plurality of output ports. Thus, in the configuration shown in FIG. 6, a multiple position switch is shown having 3 input ports and 5 output ports. Rod 63 which extends from side to side carries 2 sliders 65 and 67. The sliders have downwardly extending arms 69 and 71 each of which carries a male connector 73 and 75, respectively. These are connected together by means of the ribbon cable 77. Lever arm 73 has a handle 79 which extends out through the horizontal slot 81 in the front panel while there is a vertical slot 83 extending downwardly from the horizontal slot over each of the female connectors. Similarly, a handle 85 extends out from the front of the instrument and can be moved along the horizontal slot 87 and into any of the 5 vertical slots 89, each of which corresponds with one of the output female connectors. Thus, in this type of switch, one can have a plurality of output ports each of which can be independently switched to any one of several input ports. Of course, it will be understood that the provision for 3 input ports and 5 output ports in FIG. 6 is only for the purpose of illustration and that any number of input and output ports might be employed.

Figure 7:
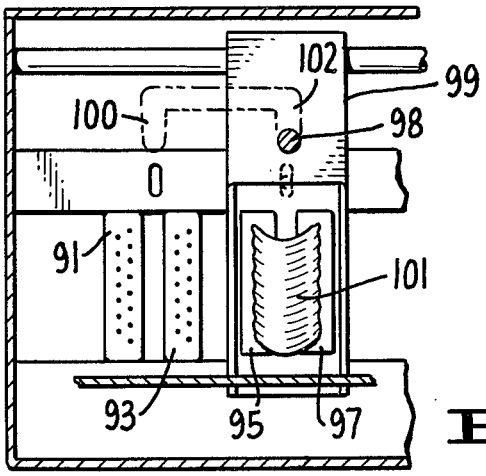
FIG. 7 is a partial front view of another embodiment of the invention wherein two sets of connectors are switched by a single lever.

FIG. 7 illustrates another embodiment of the invention where one might wish to merely jumper 2 adjacent ports together. Thus, in this embodiment of the invention, 4 female connectors are employed, 2 of which are designated 91 and 93 and 2 of which are concealed under the male connectors 95 and 97. Both of the connectors 95 and 97 are mounted on the same arm 99 and are jumpered together by means of cable 101. Handle 98 attached to arm 99 can move to two positions, i.e. into slots 100 or 102. In this way adjacent ports can be connected together so that one can connect the first and second ports together or the third and fourth ports together. Obviously this structure could be extended to provide for any number of paired ports.

Figure 8:
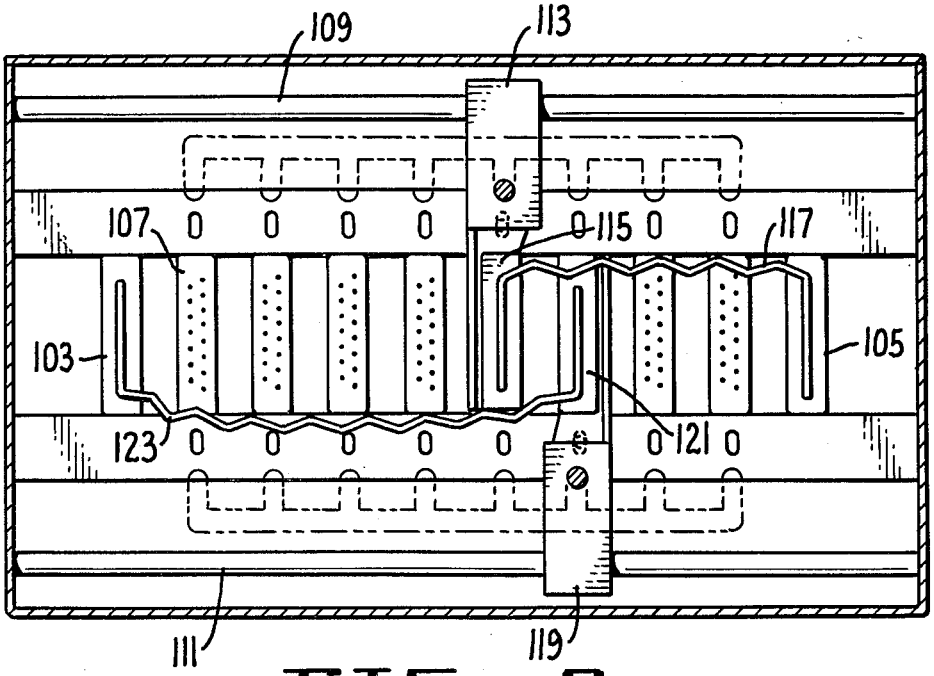
FIG. 8 is a front view of another embodiment of the invention showing how multiple sliders can be used enabling a plurality of input ports to be switched to a plurality of output ports and wherein the sliders can cross over each other.

FIG. 8 is another configuration of the invention shown wherein there are 2 input ports designated 103 and 105. Eight output ports are provided each having a female connector such as that designated 107. In this configuration, one desires to connect either input to any output so that it is necessary for the male connectors to cross over each other. To provide for this, 2 rods 109 and 111 are provided, one located near the top of the cabinet and one near the bottom. Rod 109 has a slider 113 which carries a male connector 115 connected by means of flexible cable 117 to input port 105. Similarly, rod 111 carries a slider 119 which carries the male connector 121 which is connected by means of a flexible cable 123 to the input port 103. The rest of the structure is as has been previously described. Thus, with this configuration, the connectors 115 and 121 can be plugged into any of the output connectors and can cross over each other as is shown in FIG. 8.

Figure 9:
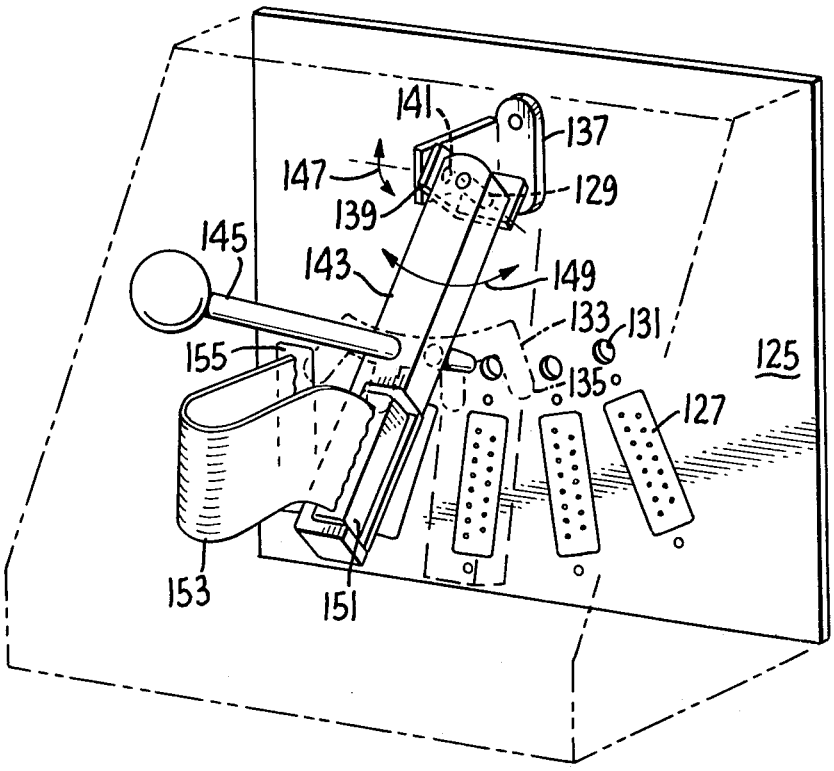
FIG. 9 illustrates another embodiment of the invention wherein the lever actuator pivots rather than slides.

In FIG. 9 another configuration of the invention is shown which, instead of employing a slider, employs an arm which is pivoted in two planes at right angles to each other. In this figure, the back wall 125 carries a plurality of female connectors 127 which are in side by side configuration but arranged radially around an imaginary circle which has a center approximately on pin 129. Above each of the female connectors 127 is a locating hole 131, again located on an imaginary circle centered on pin 129. The front panel, shown in phantom, has an arcuate slot 133 which a plurality of radial slots 135, one corresponding to each of the female connectors 127. The bracket 137 mounted on the rear wall 125 has a second bracket 139 pivoted thereon at point 141 which in turn holds the pivot pin 129 at right angles to pin 141. Arm 143 has a handle 145 can thus swing in and out as is shown by the arrow 147 or around the pin 129 as is shown by the arrow 149. The arm 143 carries a male connector 151 connected by the flexible ribbon cable 153 to the input port 155. Thus, in this configuration, handle 145 can be used to selectively insert the male connector 151 into any of the female connectors 127. Although in the figure, 4 output connectors 127 are shown, a smaller or a larger number might be used and, in fact, they could even form a complete circle rather than the semicircle illustrated.

Figure 10:
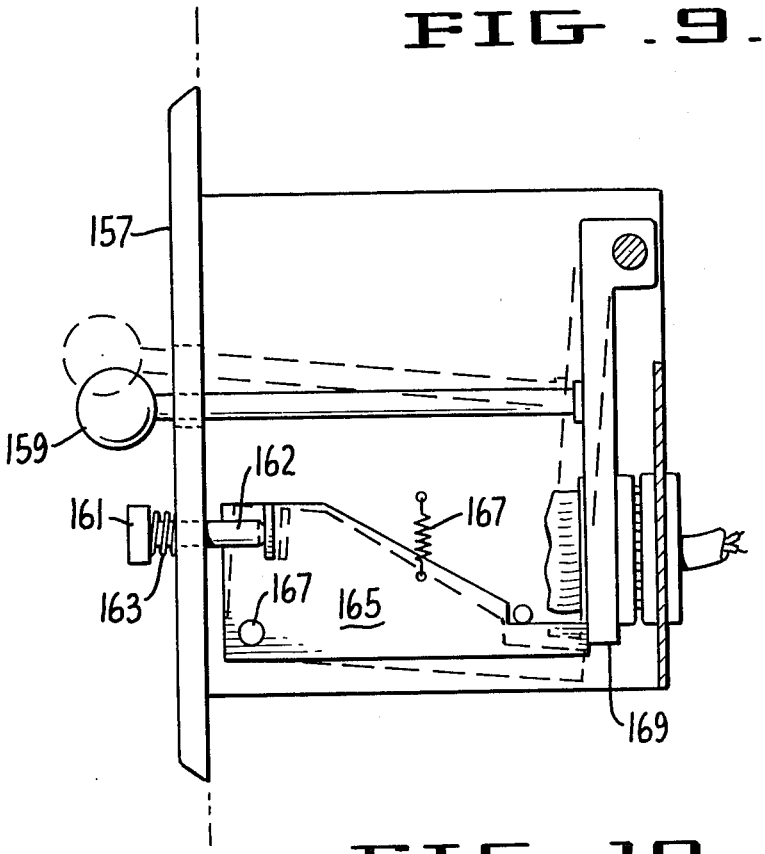
FIG. 10 is a side view of a switch, similar to FIG. 3, suitable for a panel mounting and having another form of latch.

In some installations, it may be desired to mount the switch in a standard rack mounting so that the configuration of FIG. 10 might be employed for a rack mounting instead of the configuration shown in FIG. 1 wherein the switch might merely be placed on a table. For rack mounting, the locking plate 43 might extend out too far and not be suitable. Accordingly, in this configuration of the invention, a front plate 157 might be provided. The handle 159 extends from the front of the plate 157 as well as a push button 161 on bar 162. The push button 161 has a spring 163 which normally biases the button outwardly. A locking plate 165 pivoted on pin 167 is normally held in the upper position, shown in solid lines, by means of a spring 167. The end of the locking plate 165 normally engages the pivoted arm 169 so that normally the handle 159 could not be lifted as long as plate 165 is in the upper position, as is shown in solid lines. However, if one pushes the button 161 on bar 162, plate 165 swings to the position shown in dashed lines, releasing arm 169 so that handle 159 can now be maneuvered, as is shown in dashed lines. Thus the device operates exactly as previously described except for this embodiment of the latching mechanism.

Although certain specific embodiments of this invention have been described, it will be understood that these are only for the purposes of illustration and that many variations can be made in the structure shown without departing from the spirit of this invention. For instance, other configurations of connectors might be employed as well as other numbers of input and output ports.

I claim:

1. A switch for connecting a plurality of conductors to one of a plurality of ports, comprising in combination:

a. at least one first connector of the plug-in type having a plurality of contacts therein, said contacts being connected to individual wires of flexible multiple conductors, b. a plurality of complementary second connectors of the plug-in type mounted on a frame and facing in the same direction, each having contacts complementary to the contacts of a first connector, c. a lever arm attached to said first connector and mounted for restricted movement on said frame and having a handle thereon, whereby:

d. an operator can actuate said handle to move said first connector to a selected one of said second connectors and plug said connectors together.

2. The switch of claim 1 wherein said first connector has a locating device and each second connector has a complementary, mating locating device adjacent to but separated from said connector whereby the mating devices mesh and guide the first connector into alignment with a selected second connector.

3. The switch of claim 2 wherein the mating devices include a pin adjacent the first connector and a hole adjacent each of the second connectors.

4. The switch of claim 1 having a lock means associated with said lever arm whereby said lock means must be disabled before said lever arm can be moved.

5. The switch of claim 4 wherein said lever has an arm extending to a pivoted plate and biasing means on said plate urging said plate into contact with said arm and preventing movement of said arm when said plate is in contact with said arm, and means whereby said arm can be moved out of contact with said arm, by pressure on said plate, releasing said lever.

6. The switch of claim 5 wherein said plate forms part of a switch housing and extends outwardly from the front of said switch allowing a user to press directly on said plate.

7. The switch of claim 5 having a bar extending to the front of the switch with a mechanical connection between said bar and said plate whereby pressing on said bar will depress said plate and release said arm.

8. The switch of claim 1 wherein said switch is housed in a cabinet, said cabinet having a wall generally parallel to and in front of said second connectors, said wall having a first slot extending across the second connectors and a plurality of second slots generally at right angles to and intercepting said first slot, said second slots corresponding in number to said second connectors, and said handle extending out through the slotted wall thus provided, whereby said second slots serve to indicate the positions of said second connectors.

9. The switch of claim 8 wherein said wall has indicia thereon to identify said second connectors.

10. The switch of claim 1 wherein the first conductor is of a male configuration and the second conductors are of a female configuration.

11. The switch of claim 1 wherein said flexible, multiple conductor is a ribbon cable.

12. The switch of claim 1 wherein said second connectors are mounted in side by side configuration and said lever arm is mounted on sliding means extending across said second connectors and is pivoted for in-and-out movement with respect to said second connectors.

13. The switch of claim 12 wherein said sliding means includes a rod extending from side to side and said lever arm is mounted on a slider adapted to be moved along said rod.

14. The switch of claim 12 wherein said switch is mounted on means having a wall parallel to the plane of said second connectors, said wall having slot means therein and said lever arm is mounted on a slider adapted to move in said slot means.

15. The switch of claim 12 wherein said second connectors are mounted in a radial configuration around at least a segment of an imaginary circle and said lever arm is pivoted in a first plane at the center of said circle to pivot around said circle and in a second plane to pivot in and out from said circle.

16. The switch of claim 1 having at least two first connectors, each of said first connectors having an individual lever arm whereby each of said first connectors can be moved independently to a second connector.

17. The switch of claim 16 wherein each of said lever arms has an independent mounting means whereby said first connectors can pass over each other.

18. The switch of claim 16 wherein said first connectors are connected to each other by a flexible, multiple conductor.

19. The switch of claim 16 wherein each of said first connectors is wired to a separate port.

20. The switch of claim 1 wherein said lever arm carries a plurality of first connectors.

21. The switch of claim 20 wherein two first connectors are provided in side by side configuration, with jumpers between corresponding contacts of said connectors.

* * * * *